United States Patent [19]

Gray et al.

[11] 4,119,525

[45] Oct. 10, 1978

[54] MANUFACTURE OF COKE

[75] Inventors: Michael David Gray; Geoffrey Michael Kimber, both of Cheltenham, England

[73] Assignee: Coal Industry (Patents) Limited, London, England

[21] Appl. No.: 688,777

[22] Filed: May 21, 1976

[30] Foreign Application Priority Data

Jun. 9, 1975 [GB] United Kingdom ..... 24675/75

[51] Int. Cl.[2] ..... C10G 1/04

[52] U.S. Cl. ..... 208/8; 201/41; 208/131

[58] Field of Search ..... 201/41, 25; 423/461, 423/447.1; 208/8, 131

[56] References Cited

U.S. PATENT DOCUMENTS

| | | | |
|---|---|---|---|
| 3,379,638 | 4/1968 | Bloomer et al. | 208/131 X |
| 3,966,585 | 6/1976 | Gray et al. | 208/131 X |

*Primary Examiner*—Morris O. Wolk
*Assistant Examiner*—Roger F. Phillips
*Attorney, Agent, or Firm*—Stevens, Davis, Miller & Mosher

[57] ABSTRACT

A low-impurity coke suitable for the production of electrodes for aluminium manufacture is prepared by extracting coal volatile matter content greater than about 28% by weight on a dry ash free basis with a highly aromatic hydrocarbon extractant of which the middle 90% boils in the range 250° to 350° C at a temperature of about 380° to 450° C, in the liquid phase, insoluble matter is separated off and the extract is heated to remove distillable oil and coked wherein the residence time of coal in the extraction step is controlled and the weight ratio of extractant to coal during extraction is maintained greater than 3:1 to maintain a substantially constant specific resistivity of the filter cake.

4 Claims, No Drawings

MANUFACTURE OF COKE

This invention concerns the manufacture of coke and particularly concerns the manufacture of coke suitable for use in the manufacture of carbon electrodes.

Coke for carbon electrodes for aluminium manufacture are usually made by coking petroleum residues. While coke for such carbon electrodes does not need to satisfy the high standards demanded for metallurgical graphite electrodes, it should be of high purity. Particularly important are low concentration of metals such as titanium and vanadium which become incorporated in the aluminium, elements such as phosphorous which could poison the manufacturing process and a low sulphur content (the sulphur attacks the steel electrical contacts and is an atmospheric pollutant).

It is to be expected that with the depletion of petroleum reserves, the quantities of petroleum residues available for coking will become reduced, and that this will be emphasised by the treatment of the residues to obtain more of the valuable distillable oils. In addition, the impurities, for example the vandium and sulphur, become more concentrated in the residues, and it is very difficult and consequently expensive to remove these impurities. Further it may be predicted that there may be a shortage of electrode binder; the present inventors believe that it could be more economic and logical to extend the use of petroleum residues as binders and to make up the shortfall for electrode manufacture by coke from coal according to the present invention.

The present invention has the aim of producing a coke suitable for electrodes for the aluminium industry, but based on coal. The coke produced in accordance with the invention has generally significantly reduced sulphur and other impurities compared with that currently produced from petroleum residues, and this important difference can be expected to increase as lower quality petroleum residues have to be coked.

The present invention provides a process for the production of low-impurity coke for the production of electrodes for aluminium manufacture, which process comprises extracting a coal with a highly aromatic hydrocarbon extractant at a temperature of at least 350° C., in the liquid phase, to form an extract and insoluble matter, separating the insoluble matter from the extract, heating the separated extract to distill off a distillable oil and coking the residue to form said low-impurity coke. The separation step is in general hereinafter referred to as filtration, but the invention is not limited to filtration as a method of separation.

A wide variety of highly aromatic extractants may be employed in the present invention. Such solvents are known to extract the coal substance from the coal. The term "to extract" as used herein in relation to coal, is used in its normal sense in the art of coal chemistry, that is to say, in the sense of solution either as a physical dissolution or as a result of a chemical change, molecular change, or solvation. The coal substance may react with the molecules of the extractant. The product of such an extraction may be referred to as a "coal extract" although in the art the terms "coal solution" and "coal digest" are also employed.

The extractant may be of coal origin or petroleum origin, and may at least partly coke under the coking conditions. In general, high boiling aromatic oil extractants containing aromatic hydrocarbons as their major constituents, but in which a not insubstantial proportion of nitrogen and oxygen containing compounds, especially heterocyclic compounds and phenols respectively, may often be present, may be used. Because of their low boiling point, it is normal in prior processes in the manufacture of coal extracts to use an extractant from which the low boiling constituents, particularly benzene, toluene and xylenes, have been removed. Preferred coal-based extractants include fractions of coal tars, which are the volatile products formed in the destructive distillation of coal, including the pitch fraction. Other high boiling aromatic oils having constituents similar to tar oils may be employed. Certain petroleum oils or residues may be employed. For example, the solvent may be a highly aromatic petroleum fraction boiling within the range of 200° to 500° C.; such fraction preferably having a low Conradson carbon content and an atomic hydrogen/carbon ratio of under 1:1. Typical extractants in this case may be carbon black oil, thermal tar or cat cracking slurry and the Conradson carbon content may preferably be within the range of 5% to 10% and the atomic hydrogen to carbon ratios under 1.0. Also to be mentioned are reduced crudes, i.e. petroleum streams mainly containing material boiling above 400° C.

The solvent may comprise one or more of carbon black oil, thermal tar and cat cracking slurry together with anthracene oil. The proportion of carbon black oil may be greater than 50% by weight of the solvent.

Of particular use in the process of the present invention as an extractant are the so-called "anthracene oils" although they do not necessarily contain large quantities of anthracene. The preferred anthracene oils contain quantities of phenanthrenes. A suitable boiling range for these anthracene oils is within the range 180° to 400° C. and it is often convenient to use a solvent having a boiling range, for example where the middle 90% of the solvent boils between 250° and 350° C.

Hydrogenated aromatic compounds may be included as at least part of the extractant and such hydrogenated aromatic compounds include, for example, tetralin. The use of such hydrogenated aromatic compounds, however, may substantially increase the cost of the process.

It is to be noted that even if petroleum residues are used as the extractant, the coke formed according to the present invention should be lower in impurities than coke formed by directly coking said residues.

The use of heavy, i.e. high boiling extractants permits the extraction to be carried out at or close to atmospheric pressure, with a saving in process and capital costs compared with the use of lighter oils as previously proposed in coal extraction for electrode coke manufacture. It is not necessary to incur the expense of adding quantities of gaseous hydrogen during extraction, indeed this can have the effect of making the separation step more difficult. Small quantities of hydrogen may be produced during the digestion and such autogenic hydrogen is permitted since it has little overall effect on the solvent or the coal.

The coal may be crushed and ground in conventional crushing and grinding equipment. The size of the particles of the coal is conveniently such that it passes through a sieve having 15 mm spaced mesh but smaller particles may be employed, for example such that 90% of the coal passes through a 5 mm spaced mesh. The coal may be crushed to a size of less than 500 microns or less than 200 microns; but in the process of the invention coal size does not determine the rate of extraction.

The coal may be mixed with the extractant in any convenient mixing equipment to form a slurry or suspension in the liquid solvent. The solvent may be at such a temperature above ambient temperature that the mixture of the coal and solvent remains sufficiently fluid and readily transferable by generally available and simple equipment; preferably the extractant is at such a temperature or sufficient heat may be supplied during the mixing that the temperature of the mixture of the coal and extractant is, after mixing, greater than 110° C. Thus when mixing is carried out at atmospheric pressure, water contained in or with the coal is vaporised. This is particularly advantageous as otherwise a large amount of water vapour may be required to be heated to the extraction temperature.

The inventors have discovered that ageing of coal, whether by oxidation by standing, even for a few hours, in air or by heating in air to dry the coal, can reduce the amount of coal extracted drastically. In other words, the coal immediately after mining can be extracted to a far greater extent than if it is stored for some time before use. Also, the decrease in amount of coal extracted with time after mining is dependent on the size of the coal; large lump coal retains its extractability significantly better than ½ inch size and ½ inch size better than pulverised fuel size. It has also been discovered that pre-heating coal in the absence of extractant, irrespective of whether the coal is kept under air, nitrogen or vacuum during the heating, reduced the extent of extraction. It is therefore preferable to use the coal as soon as possible after mining, and if this is not practicable the coal should be stored under water in large lumps. The coal is preferably then drained of water and used as soon as possible without drying by heating; if drying is required then this should be done in the presence of the extractant.

The extractant to coal ratio is preferably from 2 to 1 to 4 to 1 and the ratios employed may be as low as 0.5 to 1 or as high as 10 to 1. The extractant to coal ratio is, however, also influenced by the separation, e.g. filtration, requirements and the filtration requirements are such that the viscosity of the extract presented for filtration and the specific resistivity of the filter cake should be low. In consequence the extractant to coal ratio is dependent on the properties of the extractant used but is normally 3 or 4:1.

In one aspect of the invention, the extractant-coal mixture is formed into a slurry and the slurry of coal is passed to a preheater so that it is heated rapidly close to the temperature at which extraction is to occur. It is of some importance to ensure that preheating is rapid in order to limit the increase in viscosity of the slurry and to ensure that there is turbulent flow in the preheater which diminishes the tendency of the slurry to coke onto the surfaces of the preheater.

The extraction is then carried out during which the coal tends to be broken down and depolymerised by rupture of the various cross-linking bonds within the coal material itself. At any given temperature, it can be shown that the viscosity of the extract varies with time. It initially increases in a first stage, decreases to a minimum in a second stage, and increases to a second maximum in a third stage and then begins to reduce slowly in a fourth stage.

In the first stage, the rise in viscosity takes place rapidly during extraction and reaches a peak within a few minutes of the commencement of the extraction. At the onset of extraction, particles of coal are mixed with the extractant in the form of a slurry and as digestion commences viscosity increases rapidly.

In the second stage, after reaching a peak, the viscosity of the extract drops over a period of 20 to 30 minutes to a minimum. This period appears to be substantially independent of temperature when the temperature of extraction is within the range of 380° to 450° C., but the minimum viscosity reached at the end of the second period is clearly dependent on the temperature and it will be appreciated that the higher the temperature the lower the ultimate viscosity. The decrease in viscosity during the second stage is generally though to be as a result of depolymerisation of the coal substances. In the third stage, after passing a point of minimum viscosity, the viscosity again increases to a maximum which is reached during a period 50 to 70 minutes after commencement of extraction in the stated temperature range. The increase in viscosity is due to some extent to repolymerisation reactions occurring within the digest; these obviously commence before the point of minimum viscosity (at the end of stage two) is reached. The rate of increase in viscosity is not greatly changed with the temperature, thus indicating a low activation energy for the process which is consistent with a repolymerisation reaction.

In the fourth stage, after reaching the second maximum, the viscosity decreases. This, to some extent, results from rearrangement of the polymerising molecules prior to their decomposition to coke.

If the coking reaction is allowed to proceed to completion the extract would have almost the same solid content as the original coal slurry and thus a similar low viscosity. The higher the temperature and/or the greater the residence time, the greater the coking reaction is advanced. Howver, it must be recognised that all extractants could be coked, albeit at a slower rate than that of the dissolved coal substance, and if sufficient time were allowed there will be a relatively sudden increase in viscosity as the solids content of the extract being coked reaches a critical level (this occurs at about 60% solids).

The concentration of extractant to coal during extraction is not critical in its effect on the filter cake, but the concentration of extractant to coal in the filtrate is significant and it is preferred that filtration is effected with a concentration of extractant to coal greater than 3:1 and preferably of the order of 4:1 since this results in a lower viscosity and therefore greater ease of filtration at temperatures around 250° C. After the extraction step, therefore, an additional proportion of extractant may be added to lower the viscosity preparatory to the separation step. In the alternative, a proportion of a lower boiling fraction (e.g. a coal tar fraction such as a wash oil), may be added to lower the viscosity prior to separation. Where a lighter fraction is added, the separation may be carried out at a lower temperature.

The period of extraction is preferably greater than 20 minutes and the temperature should be as high as possible subject to the temperature not producing excessive coking of the extract, that is to say within the range of 400° to 440° C. Where continuous extraction is employed in which there is a degree of mixing, the average residence time should be greater than 20 minutes as the short residence time fractions have a deleterious effect on separation, particularly filtration, both from viscosity and cake resistivity aspects. On the other hand, the control of residence time that is essential in the production of premium grade coke for graphite electrodes is not necessary, and a greater spread of residence times can be allowed. This permits the use of simpler equipment which is favourable as regards capital cost.

It is preferred that the size of particles in the coal extract after separation, calculated as a percentage by weight relative to the final yield of coke product, is such that less than about 10% down to about 5% in the coal extract itself comprises particles having a particle size greater than one micron. In general, the smaller the residual particles in the coal extract the better.

After separation, the coal extract is then coked. The coking operation is preferably carried out in a delayed coker. In the formation of coke, molecules containing carbon and hydrogen condense and form extended cross-linked chains whereby smaller molecules are eliminated. The chains are gradually extended and cross-linked by thermal action until a solid infusable insoluble mass of coke is formed. As the temperature of the coke is raised, more hydrogen and other elements are eliminated until the coke consists essentially of carbon and non-volatile mineral matter constituents, the latter often in the form of oxides.

The initial coking action is preferably carried out at a temperature within the range of 450° to 550° C., and temperatures greater than 480° C. are preferable. The material that is actually subjected to coking may be the coal extract from which a proportion of the volatile matter, including extractant if volatile, has been removed. The coal extract may alternatively have had added to it the further amount of extractant or lower boiling fraction. This addition is particularly advantageous in delayed coking.

The filtrate or extract after separation from the insolubles can be heated prior to coking to remove the volatile distillable oil which may be extractant and/or a by-product of the extraction, or the distillable oil may be collected during the actual coking. The distillable oil may be recycled in the process of the invention as extractant, thus reducing the raw material consumption, or may be used as an extractant for the treatment of low volatile coals in a process for the production of premium grade electrode coke. In the latter cases the extractant has already been refractorised.

The invention is illustrated by the following Examples:

EXAMPLE 1.

In a particular process in accordance with the present invention a coal of 56% VM daf basis (Volatile matter, dry ash free basis) was air dried at ambient temperature and crushed to −200 microns. A digester was charged with a quantity (24.5 kg) of this coal and 34.6 kg of recycled anthracene oil (i.e. oil that had been recovered from a coal solution, thereby removing from crude anthracene oil those components that coke rapidly). The slurry temperature was increased rapidly to 120°–130° C. and was maintained at that temperature under a gauge pressure of 0.7 at. until drying was completed. After completion of steam evolution the temperature and gauge pressure were raised to 375° C. and 4.2 at. and digestion carried out for 1 hour at that temperature. Thereafter the product was cooled to 250° C. and filtered under a gauge pressure of 2.1 at.. The filtrate was collected and the temperature was increased at a rate of 50° C. per hour to 485° C. or thereabouts during which coking took place. The solvent evaporated was collected for re-use and lumps of coke were removed from the coker and transferred to a furnace and heated to 1300° C. at a rate of 600° C. per hour. The resultant coke was assessed as a potential anode coke for the aluminium industry.

EXAMPLE 2.

Example 1 was repeated, using a coal of 39.3% VM, digester charge 13.6 kg:54.5 kg coal:oil, digestion temperature 400° C.

EXAMPLE 3.

A coal of 39.3% VM was air dried and ground to −200 microns. It was then mixed at 140° C. in a batch mixing tank with 4 times its own weight of refracterised anthracene oil. This slurry was then fed at about 70 kg/h through a preheater which raised its temperature to 400° C. in less than 1 minute: the preheated slurry was then fed to a vessel held at 400°–410° C. under a gauge pressure of 8.4 at. wherein the average residence time was 1½ hours. The digest was then rapidly cooled to 200° C. prior to filtration. 1500 kg of the filtrate so produced was then fed at 120 kg/h to a delayed coking drum, after being preheated to 525° C. The coke so produced was water quenched prior to removal and calcination.

EXAMPLE 4.

Example 3 was repeated, using a coal of 25.4% VM and a preheat temperature of 510° C.

All the cokes produced in the examples, together with others using different coals, meet the requirements of the coke used in the manufacture of anodes for the aluminium industry.

Table 1 below gives the characteristics of the coals used in above Examples, and Table 2 gives the characteristics of the cokes produced.

TABLE 1.

| | | Analyses of coals used | | |
|---|---|---|---|---|
| | | Example 1 | Example 2 & 3 | Example 4 |
| Moisture | a.r. | 52.7 | 5.5 | 0.7 |
| Ash | a.r. | 1.8 | 4.0 | 9.0 |
| VM | d.a.f. | 56.0 | 39.3 | 25.4 |
| C | d.a.f. | 70.6 | 84.2 | 89.4 |
| H | d.a.f. | 4.9 | 5.4 | 4.9 |
| N | d.a.f. | 0.9 | 1.9 | 1.4 |
| O | d.a.f. | 23.6 | 7.6 | 3.2 |
| S | d.a.f. | 0.15 | 0.7 | 1.9 |

a.r. = as received
d.a.f. = dry ash free basis

TABLE 2.

| | Analyses of coal extract cokes | | | |
|---|---|---|---|---|
| | Example 1 | Example 2 | Example 3 | Example 4 |
| Sulphur | 0.35 | 0.50 | 0.50 | 0.8 |
| Ash | 00.43 | 0.53 | 0.53 | 0.3 |
| Real Density | 2.07 | 2.00 | 2.00 | 2.04 |
| Bulk Density | | | | 0.87 |
| Iron | | | | 0.03 |
| Silicon | | | | 0.012 |
| Vanadium | | | | 0.003 |
| Nickel | | | | 0.003 |
| Cadmium | | | | 0.008 |

The material obtained by the process described above has been found to be suitable for the production of aluminium grade electrodes by conventional methods. The density of the material obtained and certain other properties are not sufficient to be classified as suitable for premium grade electrode coke but the ready availability of suitable coal renders it ideally suitable for a cheap and easy method of producing regular grade calcined coke suitable for use as electrodes in the manufacture of aluminium.

The low rank coals, that is to say those having high proportions of volatile products, particularly greater than 28% by weight on a dry ash free basis, tend to give lower yields of coke but against this these coals are lower in cost and are in good supply. Refractorisation of the extractant is not expected to be necessary in order to achieve the required coke quality thereby resulting in a further saving of costs. Coke formed from the extractant can be allowed to "adulterate" the product coke without seriously affecting product quality.

To achieve adequate filtration and low filter cake resistivity the actual extraction conditions tend to be fairly critical.

When using filtration as the separation step it is preferred to observe the specific resistivity of the filter cake and to control the extraction, e.g. by control of residence time, coal to extractant ratio etc., to maintain a substantially constant specific resistivity.

We claim:

1. A process for the production of low impurity coke for the production of electrodes, which process comprises extracting a coal of volatile matter content greater than about 28% by weight on a dry ash free basis with an anthracene oil, recycled or refractorised anthracene oil of which the middle 90% boils in the range 250° to 350° C., at a temperature of about 380° to 450° C., in the liquid phase, to form an extract and insoluble matter, separating the liquid matter from the insoluble matter, heating the separated extract to distill off a distillable oil at least a portion of which is recycled as extractant and coking the residue to form said low-impurity coke wherein the residence time of coal in the extraction step is controlled and the weight ratio of extractant to coal during extraction is maintained greater than 3:1 to maintain a substantially constant specific resistivity of the filter cake.

2. The process as claimed in claim 1, wherein the extractant-coal mixture in the form of a slurry is heated rapidly to or close to the temperature at which extraction is to occur.

3. The process as claimed in claim 1, wherein the filtration is carried out at about 250° C.

4. The process as claimed in claim 1, wherein the coking is effected at a temperature greater than about 480° C.

* * * * *